US011784411B2

(12) United States Patent
Ling et al.

(10) Patent No.: US 11,784,411 B2
(45) Date of Patent: Oct. 10, 2023

(54) WIRELESS COMMUNICATION APPARATUS AND PRINTED DUAL BAND ANTENNA THEREOF

(71) Applicant: REALTEK SEMICONDUCTOR CORPORATION, Hsinchu (TW)

(72) Inventors: Ching-Wei Ling, Hsinchu (TW); Chih-Pao Lin, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 20 days.

(21) Appl. No.: 17/524,910

(22) Filed: Nov. 12, 2021

(65) Prior Publication Data

US 2022/0158348 A1 May 19, 2022

(30) Foreign Application Priority Data

Nov. 18, 2020 (TW) ..... 109140207

(51) Int. Cl.

| | |
|---|---|
| ***H01Q 1/38*** | (2006.01) |
| ***H01Q 5/378*** | (2015.01) |
| ***H01Q 9/04*** | (2006.01) |

(52) U.S. Cl.

CPC ..... *H01Q 5/378* (2015.01); *H01Q 1/38* (2013.01); *H01Q 9/0421* (2013.01)

(58) Field of Classification Search

CPC ..... H01Q 5/378; H01Q 1/38; H01Q 9/0421; H01Q 9/42

See application file for complete search history.

(56) References Cited

U.S. PATENT DOCUMENTS

| | | | | |
|---|---|---|---|---|
| 8,232,922 | B2 | 7/2012 | Ammann et al. | |
| 8,599,074 | B2 | 12/2013 | Wong et al. | |
| 9,711,858 | B1 * | 7/2017 | Lee | H01Q 9/06 |
| 2006/0066487 | A1 | 3/2006 | Park et al. | |
| 2008/0180333 | A1 | 7/2008 | Martiskainen et al. | |

(Continued)

FOREIGN PATENT DOCUMENTS

| | | |
|---|---|---|
| TW | 200818597 A | 4/2008 |
| TW | 200835055 | 8/2008 |
| TW | 201114101 A | 4/2011 |

OTHER PUBLICATIONS

Machine translation of Applicant cited Chou et al. TW Publication TW200818597A (Year: 2008).*

(Continued)

*Primary Examiner* — Hai V Tran
*Assistant Examiner* — Michael M Bouizza
(74) *Attorney, Agent, or Firm* — WPAT, P.C

(57) ABSTRACT

The present invention discloses a printed dual band antenna that includes a primary radiation portion and a parasitic radiation portion. The primary radiation portion is configured to perform signal transmitting and receiving based on a first resonant frequency and a second resonant frequency. The parasitic radiation portion is disposed on a neighboring side of the primary radiation portion, distanced from the primary radiation portion by a distance and electrically isolated from the primary radiation portion. The parasitic radiation portion couples to and resonates with the primary radiation portion to perform signal transmitting and receiving based on the second resonant frequency. The parasitic radiation portion is a grounded monopole parasitic antenna.

9 Claims, 7 Drawing Sheets

(56) References Cited

U.S. PATENT DOCUMENTS

| | | | | |
|---|---|---|---|---|
| 2009/0207092 | A1* | 8/2009 | Nysen | H01Q 9/20 343/893 |
| 2011/0260939 | A1* | 10/2011 | Korva | H01Q 9/42 343/725 |
| 2012/0249393 | A1* | 10/2012 | Hotta | H01Q 7/00 343/843 |

OTHER PUBLICATIONS

OA letter of the counterpart TW application (appl. No. 109140207) dated Jun. 10, 2021. Summary of the OA letter (Jun. 10, 2021). 1.Claims 1~2, 5~6 and 8~10 are rejected as being anticipated by the disclosure of the cited reference 1 (TW200835055 A).2. Claim 7 is rejected as being unpatentable over the disclosure of the cited reference 1. 3. Claims 3~4 are rejected as being unpatentable over the disclosure of the cited reference 1 and the cited reference 2 (US2008/0180333 A1).

1) OA letter of a counterpart TW application (appl. No. 109140207) dated Feb. 16, 2022) Summary of the OA letter: 1. Claims 1. 5~6 and 9 are rejected as being anticipated by the disclosure of the cited reference 1 (TW200818597A). 2. Claims 7 and 10 are rejected as being unpatentable over the disclosure of the cited reference 1.

OA letter of the counterpart TW application (appl. No. 109140207) dated Oct. 26, 2021. Summary of the OA letter(Oct. 26, 2021): 1. Claims 1 5~6 and 9 are rejected as being anticipated by the disclosure of the cited reference 1 (TW201114101A, also published as U.S. Pat. No. 8,599,074B2).

2. Claims 7 and 10 are rejected as being unpatentable over the disclosure of the cited reference 1. 3. Claims 2, 3 and 8 are rejected as being unpatentable over the disclosure of the cited reference 1 and the cited reference 2 (TW200835055 A). 4. Claims 4 are rejected as being unpatentable over the disclosure of the cited reference 1 and the cited reference 3 (US2008/0180333 A1).

* cited by examiner

WIRELESS COMMUNICATION APPARATUS AND PRINTED DUAL BAND ANTENNA THEREOF

BACKGROUND OF THE INVENTION

1. Field of the Invention

The present invention relates to a wireless communication apparatus and a printed dual band antenna thereof.

2. Description of Related Art

The design of wideband antennas in current industry mostly uses monopole antennas since the monopole antennas have the advantages of wide bandwidth, simple structure, easy manufacturing process and almost omni-directional radiation pattern. As a result, the monopole antennas are widely used in wireless network equipments.

However, for communication devices having smaller and smaller size, a usable area of the antenna in these devices is restricted since the wideband antennas take a larger area to be disposed.

SUMMARY OF THE INVENTION

In consideration of the problem of the prior art, an object of the present invention is to provide a signal enhancement relay apparatus and a signal enhancement relay method.

The present invention discloses a printed dual band antenna that includes a primary radiation portion and a parasitic radiation portion. The primary radiation portion is configured to perform signal transmitting and receiving based on a first resonant frequency and a second resonant frequency. The parasitic radiation portion is disposed on a neighboring side of the primary radiation portion, is distanced from the primary radiation portion by a distance and is electrically isolated from the primary radiation portion, wherein the parasitic radiation portion couples to and resonates with the primary radiation portion to perform signal transmitting and receiving based on the second resonant frequency, and the parasitic radiation portion is a grounded monopole parasitic antenna.

The present invention also discloses a wireless communication apparatus that includes a circuit board, a ground plane and a printed dual band antenna. The ground plane is disposed on the circuit board. The printed dual band antenna includes a primary radiation portion and a parasitic radiation portion. The primary radiation portion is disposed on the circuit board and is configured to perform signal transmitting and receiving based on a first resonant frequency and a second resonant frequency. The parasitic radiation portion is disposed on the circuit board and on a neighboring side of the primary radiation portion, is distanced from the primary radiation portion by a distance and is electrically isolated from the primary radiation portion, wherein the parasitic radiation portion couples to and resonates with the primary radiation portion to perform signal transmitting and receiving based on the second resonant frequency, and the parasitic radiation portion is a grounded monopole parasitic antenna that is coupled to the ground plane.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

An aspect of the present invention is to provide a wireless communication apparatus and a printed dual band antenna thereof to maintain a good antenna radiation characteristic and keep an area thereof small at the same time.

Figure 1:
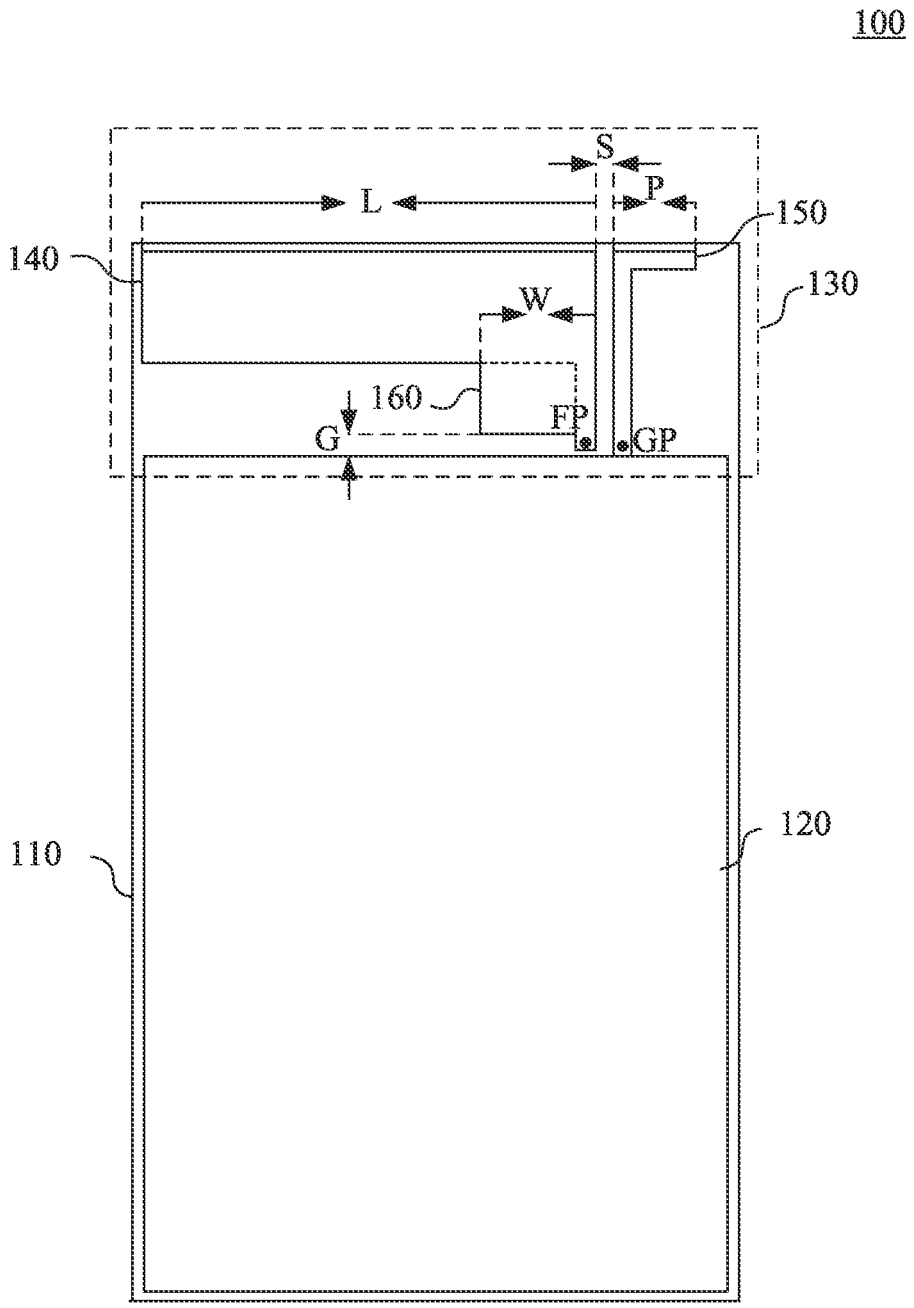
FIG. 1 illustrates top view of a wireless communication apparatus according to an embodiment of the present invention.
Figure 2:
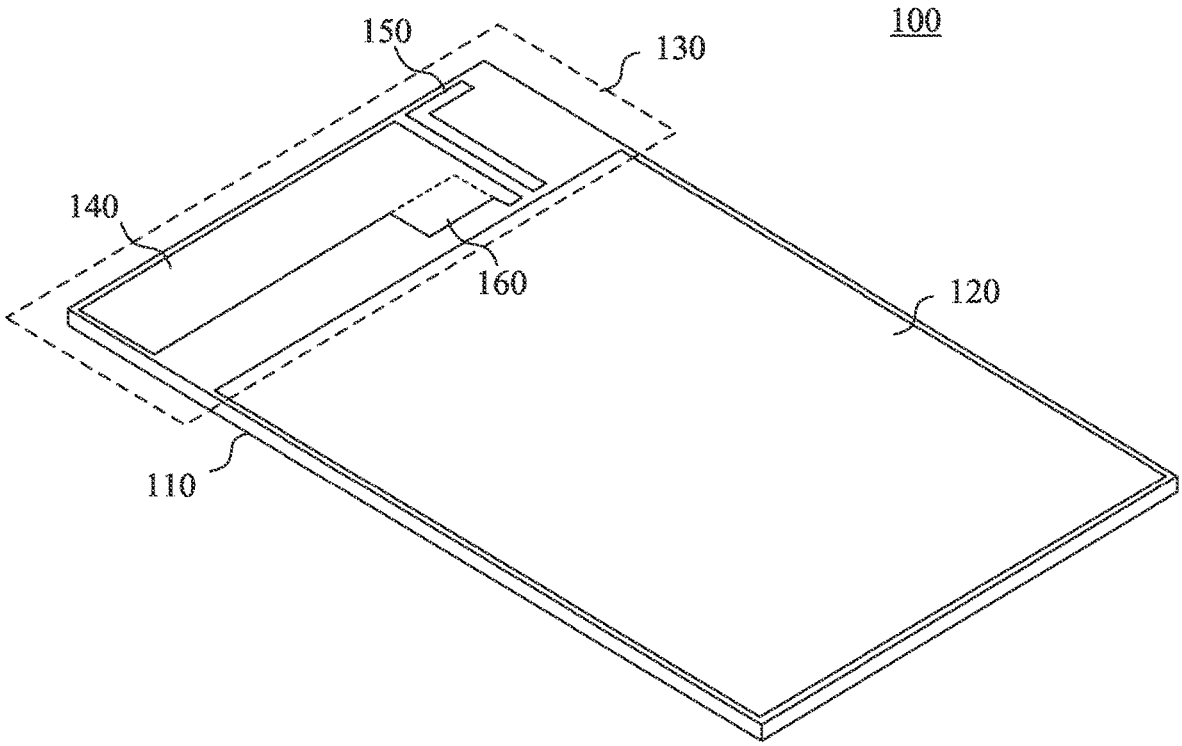
FIG. 2 illustrates a three-dimensional diagram of the wireless communication apparatus according to an embodiment of the present invention.

Reference is now made to FIG. 1 and FIG. 2 at the same time. FIG. 1 illustrates a top view of a wireless communication apparatus 100 according to an embodiment of the present invention. FIG. 2 illustrates a three-dimensional diagram of the wireless communication apparatus 100 according to an embodiment of the present invention. The wireless communication apparatus 100 includes a circuit board 110, a ground plane 120 and a printed dual band antenna 130.

In an embodiment, the circuit board 110 is a printed circuit board (PCB) and may include a material of such as, but not limited to glass fiber. The ground plane 120 is disposed on the circuit board 110. The ground plane 120 can be such as, but not limited to a metal plate that is grounded.

The printed dual band antenna 130 includes a primary radiation portion 140 and a parasitic radiation portion 150.

The primary radiation portion 140 is disposed on the circuit board 110 and is configured to perform signal transmitting and receiving based on a first resonant frequency and a second resonant frequency.

In an embodiment, the primary radiation portion 140 is a monopole primary antenna, such as but not limited to the L-shaped antenna illustrated in FIG. 1, and the L-shaped antenna includes a feeding point FP used to perform signal transmission. The feeding point FP is distanced from the ground plane 120 by a distance and is electrically isolated from the ground plane 120.

In another embodiment, the primary radiation portion 140 can be an inverted F primary antenna (not illustrated in the figure). It is appreciated that when the primary radiation portion 140 is implemented by using the inverted F primary antenna, the primary radiation portion 140 includes both the feeding point that is electrically isolated from the ground plane 120 and a grounding point that is electrically coupled to the ground plane 120.

In an embodiment, the printed dual band antenna 130 may selectively further include a matching portion 160 disposed on the circuit board 110 and coupled to the primary radiation portion 140, so as to adjust an input impedance matching.

The parasitic radiation portion 150 is disposed on the circuit board 110 and on a neighboring side of the primary radiation portion 140, distanced from the primary radiation portion 140 by a distance S and electrically isolated from the primary radiation portion 140. The parasitic radiation portion 150 couples to and resonates with the primary radiation portion 140 to perform signal transmitting and receiving based on the second resonant frequency. The parasitic radiation portion 150 is a grounded monopole parasitic antenna, such as but not limited to the L-shaped antenna illustrated in FIG. 1, in which the L-shaped antenna includes a grounding point GP that is coupled to the ground plane 120.

Figure 3:
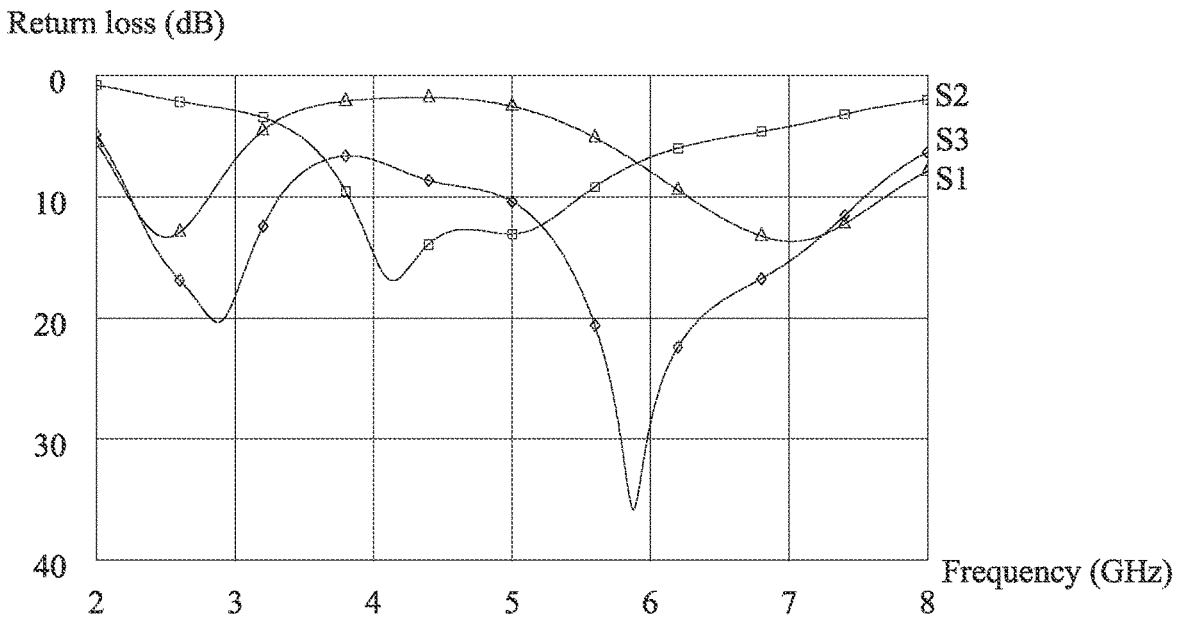
FIG. 3 illustrates a diagram of a frequency response of the printed dual band antenna according to an embodiment of the present invention.

Reference is now made to FIG. 3. FIG. 3 illustrates a diagram of a frequency response of the printed dual band antenna 130 according to an embodiment of the present invention. In FIG. 3, an X-axis represents the frequency having a unit of GHz and a Y-axis represents the return loss having a unit of dB.

As illustrated in FIG. 3, the line section S1 that includes triangle-shaped grids disposed thereon represents the frequency response under the condition that only the primary radiation portion 140 is presented. The line section S2 that includes square-shaped grids disposed thereon represents the frequency response under the condition that only the parasitic radiation portion 150 is presented. The line section S3 that includes diamond-shaped grids disposed thereon represents the frequency response under the condition that both the primary radiation portion 140 and the parasitic radiation portion 150 are presented and resonate with each other.

As the line section S1 shows, when only the primary radiation portion 140 is presented, the 10 dB bandwidth is 0.57 GHz (2.24-2.81 GHz) and 1.41 GHz (6.28-7.69 GHz). As the line section S2 shows, when only the parasitic radiation portion 150 is presented, the 10 dB bandwidth is 1.66 GHz (3.83-5.49 GHz).

As the line section S3 shows, when both the primary radiation portion 140 and the parasitic radiation portion 150 are presented and resonate with each other, the 10 dB bandwidth in a low frequency range is 1.02 GHz (2.28-3.30 GHz) and the 10 dB bandwidth in a high frequency range is 2.63 GHz (4.92-7.55 GHz). As a result, by disposing the primary radiation portion 140 and the parasitic radiation portion 150, the printed dual band antenna 130 not only satisfies the original operation of 5 GHz frequency band (5.15-5.85 GHz) of WiFi 6, but also satisfies the wideband requirement of 6 GHz frequency band (5.925-7.125 GHz) of WiFi 6E.

In different embodiments, the printed dual band antenna 130 may determine the amount of the input impedance according to the sizes of the primary radiation portion 140, the parasitic radiation portion 150 and the matching portion 160 to further determine an amount of the operation frequency.

Figure 4A:
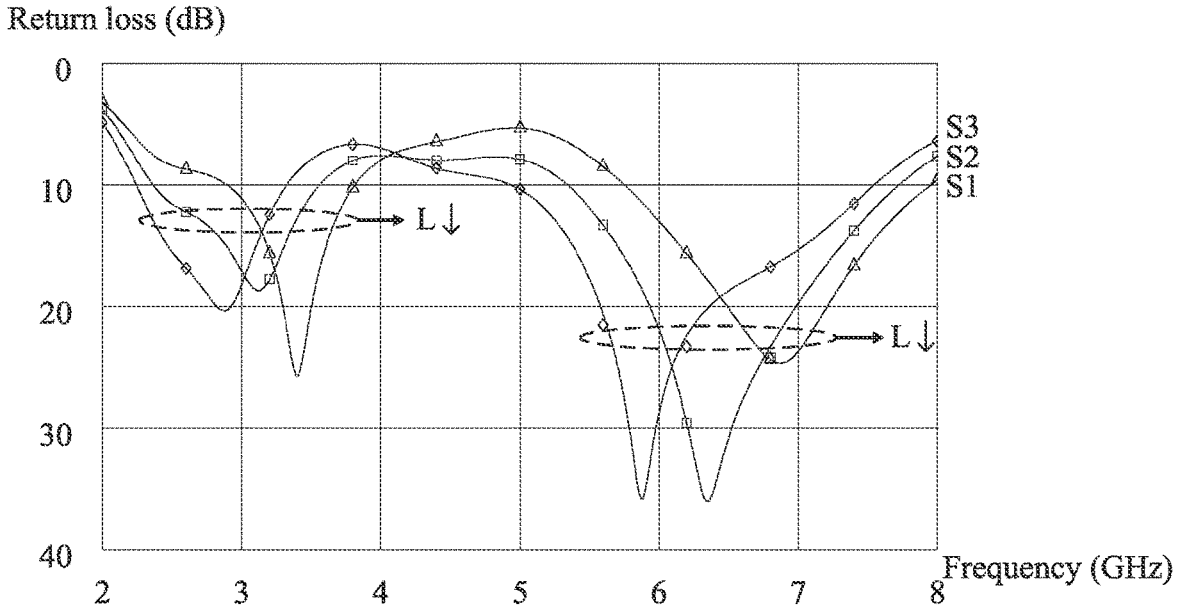
FIG. 4A illustrates a diagram of the frequency responses of the printed dual band antenna when an extending length of the primary radiation portion is different according to an embodiment of the present invention.

Reference is now made to FIG. 4A. FIG. 4A illustrates a diagram of the frequency responses of the printed dual band antenna 130 when an extending length L of the primary radiation portion 140 is different according to an embodiment of the present invention. In FIG. 4A, an X-axis represents the frequency having a unit of GHz and a Y-axis represents the return loss having a unit of dB.

As illustrated in FIG. 4A, the line section S1 that includes triangle-shaped grids disposed thereon represents the frequency response under the condition that the extending length L is 18.7 millimeters. The line section S2 that includes square-shaped grids disposed thereon represents the frequency response under the condition that the extending length L is 20.7 millimeters. The line section S3 that includes diamond-shaped grids disposed thereon represents the frequency response under the condition that the extending length L is 22.7 millimeters.

As shown in FIG. 4A, when the extending length L is longer, the operation frequencies of the antenna in the low frequency range and the high frequency range become lower. When the extending length L increases from 18.7 millimeters to 22.7 millimeters, the operation frequency of the antenna in the low frequency range decreases from 3.40 GHz to 2.87 GHz, and the operation frequency of the antenna in the high frequency range decreases from 6.86 GHz to 5.88 GHz.

Figure 4B:
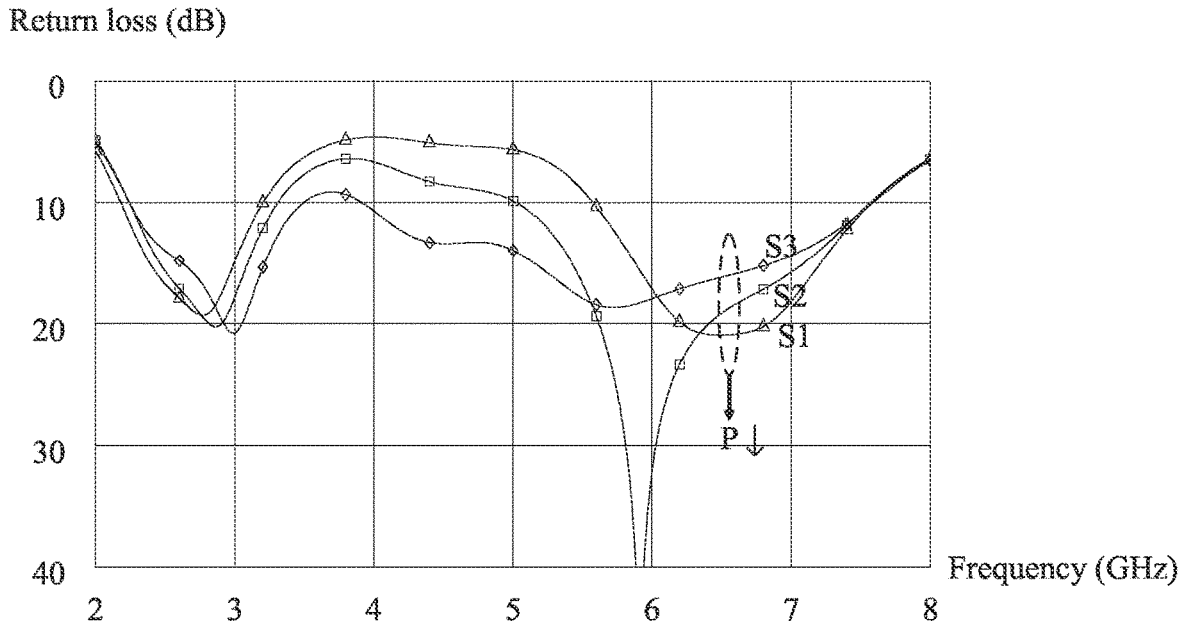
FIG. 4B illustrates a diagram of the frequency responses of the printed dual band antenna when an extending length of the parasitic radiation portion is different according to an embodiment of the present invention.

Reference is now made to FIG. 4B. FIG. 4B illustrates a diagram of the frequency responses of the printed dual band antenna 130 when an extending length P of the parasitic radiation portion 150 is different according to an embodiment of the present invention. In FIG. 4B, an X-axis represents the frequency having a unit of GHz and a Y-axis represents the return loss having a unit of dB.

As illustrated in FIG. 4B, the line section S1 that includes triangle-shaped grids disposed thereon represents the frequency response under the condition that the extending length P is 2 millimeters. The line section S2 that includes square-shaped grids disposed thereon represents the frequency response under the condition that the extending length P is 4 millimeters. The line section S3 that includes diamond-shaped grids disposed thereon represents the frequency response under the condition that the extending length P is 6 millimeters.

As shown in FIG. 4B, when the extending length P is longer, the operation frequency of the antenna in the high frequency range becomes lower. When the extending length P increases from 2 millimeters to 6 millimeters, the operation frequency of the antenna in the high frequency range decreases from 6.49 GHz to 5.74 GHz. Based on FIG. 4A and FIG. 4B, the primary radiation portion 140 and the parasitic radiation portion 150 of the printed dual band antenna 130 of the present invention are able to adjust the resonant frequencies in the low frequency range and the high frequency range respectively. As a result, when the locations of the operation frequencies of the primary radiation portion 140 and the parasitic radiation portion 150 are adjusted appropriately, a dual band antenna having wide bandwidth can be obtained.

Figure 4C:
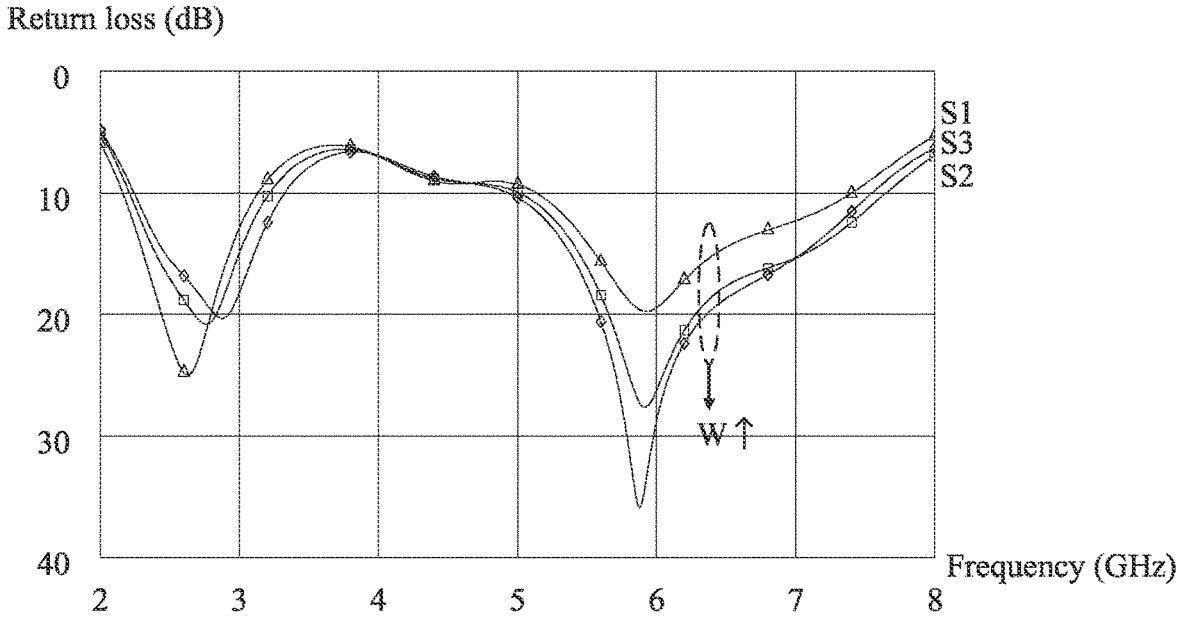
FIG. 4C illustrates a diagram of the frequency responses of the printed dual band antenna when a width of the matching portion is different according to an embodiment of the present invention.

Reference is now made to FIG. 4C. FIG. 4C illustrates a diagram of the frequency responses of the printed dual band antenna 130 when a width W of the matching portion 160 is different according to an embodiment of the present invention. In FIG. 4C, an X-axis represents the frequency having a unit of GHz and a Y-axis represents the return loss having a unit of dB.

As illustrated in FIG. 4C, the line section S1 that includes triangle-shaped grids disposed thereon represents the frequency response under the condition that the width W is 2.7 millimeters. The line section S2 that includes square-shaped grids disposed thereon represents the frequency response under the condition that the width W is 3.7 millimeters. The line section S3 that includes diamond-shaped grids disposed thereon represents the frequency response under the condition that the width W is 4.7 millimeters.

As shown in FIG. 4C, the modification of the matching portion 160 is able to adjust the input impedance of the antenna. When the width W increases from 2.7 millimeters to 4.7 millimeters, a better impedance matching is obtained. When the width W of the matching portion 160 is larger, more current paths can be provided such that the variation of the input impedance of the antenna becomes smoother to obtain a wideband matching.

Figure 4D:
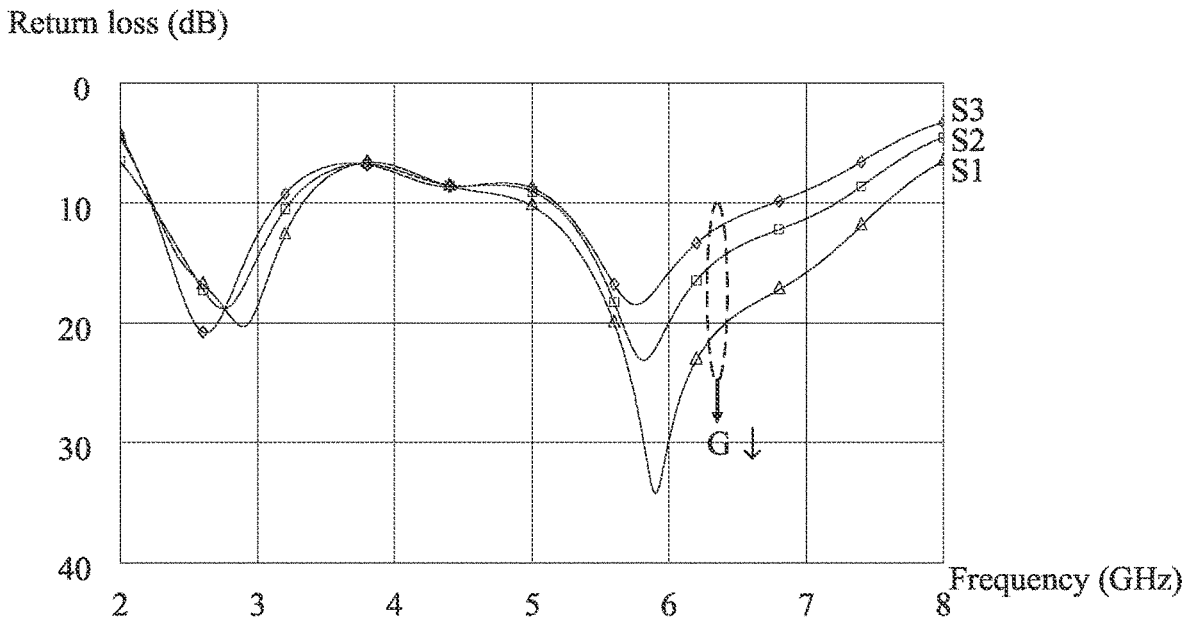
FIG. 4D illustrates a diagram of the frequency responses of the printed dual band antenna when a distance between the matching portion and the ground plane is different according to an embodiment of the present invention.

Reference is now made to FIG. 4D. FIG. 4D illustrates a diagram of the frequency responses of the printed dual band antenna 130 when a distance G between the matching portion 160 and the ground plane 120 is different according to an embodiment of the present invention. In FIG. 4C, an X-axis represents the frequency having a unit of GHz and a Y-axis represents the return loss having a unit of dB.

As illustrated in FIG. 4D, the line section S1 that includes triangle-shaped grids disposed thereon represents the frequency response under the condition that the distance G is 1.0 millimeters. The line section S2 that includes square-shaped grids disposed thereon represents the frequency response under the condition that the distance G is 1.5 millimeters. The line section S3 that includes diamond-shaped grids disposed thereon represents the frequency response under the condition that the distance G is 2.0 millimeters.

As shown in FIG. 4D, the modification of the distance G between the matching portion 160 and the ground plane 120 is able to adjust the input impedance of the antenna. When the distance G decreases from 2.0 millimeters to 1.0 millimeters, a better impedance matching is obtained.

Figure 4E:
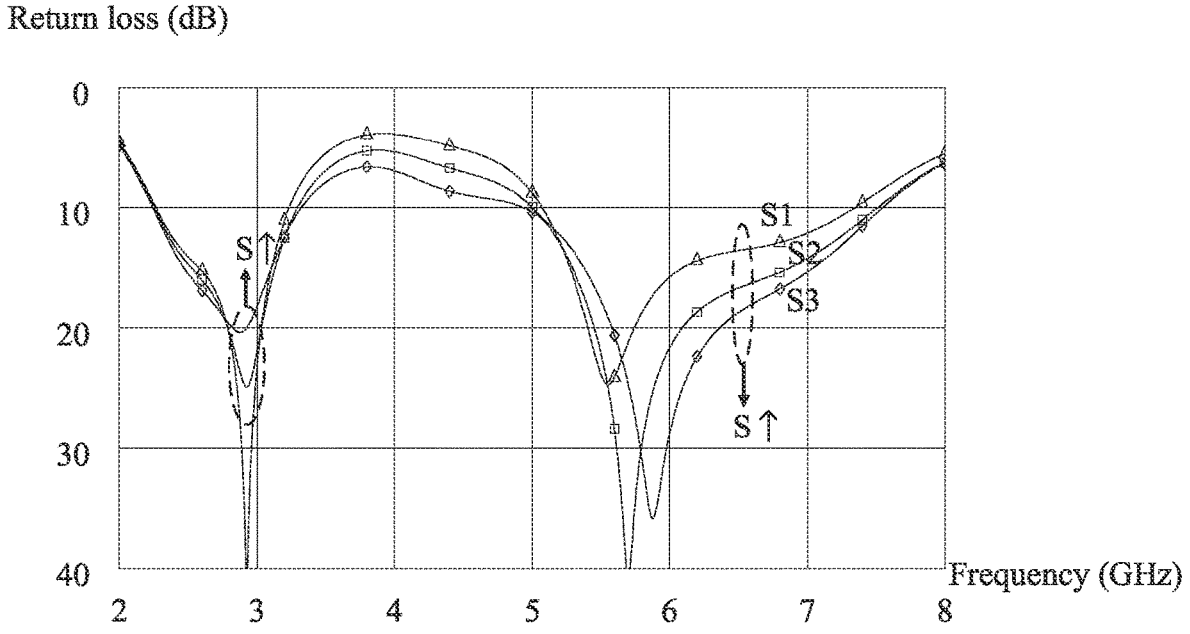
FIG. 4E illustrates a diagram of the frequency responses of the printed dual band antenna when a distance between the primary radiation portion and the parasitic radiation portion is different according to an embodiment of the present invention.

Reference is now made to FIG. 4E. FIG. 4E illustrates a diagram of the frequency responses of the printed dual band antenna 130 when a distance S between the primary radiation portion 140 and the parasitic radiation portion 150 is different according to an embodiment of the present invention. In FIG. 4C, an X-axis represents the frequency having a unit of GHz and a Y-axis represents the return loss having a unit of dB.

As illustrated in FIG. 4E, the line section S1 that includes triangle-shaped grids disposed thereon represents the frequency response under the condition that the distance S is 0.3 millimeters. The line section S2 that includes square-shaped grids disposed thereon represents the frequency response under the condition that the distance S is 0.5 millimeters. The line section S3 that includes diamond-shaped grids disposed thereon represents the frequency response under the condition that the distance S is 0.7 millimeters.

As shown in FIG. 4E, the modification of the distance S between the primary radiation portion 140 and the parasitic radiation portion 150 is able to adjust the coupling amount between the primary radiation portion 140 and the parasitic radiation portion 150, which is equivalent to adjust the input impedance of the antenna. When the distance S increases from 0.3 millimeters to 0.7 millimeters, a better impedance matching is obtained. In an embodiment, a preferable range of the distance S is from 0.2 millimeters to 0.8 millimeters.

In a numeral example, the circuit board 110 has a thickness of 1.0 millimeter, and a dimension of length and width of 50 millimeters×30 millimeters. The length and width of the ground plane 120 are 40 millimeters×30 millimeters. The length and width of the printed dual band antenna 130 are only 30 millimeters×10 millimeters. The extending length L of the primary radiation portion 140 is 22.7 millimeters. The distance G between the matching portion 160 and the ground plane 120 is 1.0 millimeter. The width W of the matching portion 160 is 4.7 millimeters. The extending length P of the parasitic radiation portion 150 is 4.2 millimeters. The distance S between the primary radiation portion 140 and the parasitic radiation portion 150 is 0.7 millimeters. However, the present invention is not limited thereto. The sizes of the components described above can be adjusted according to practical requirements.

Figure 5:
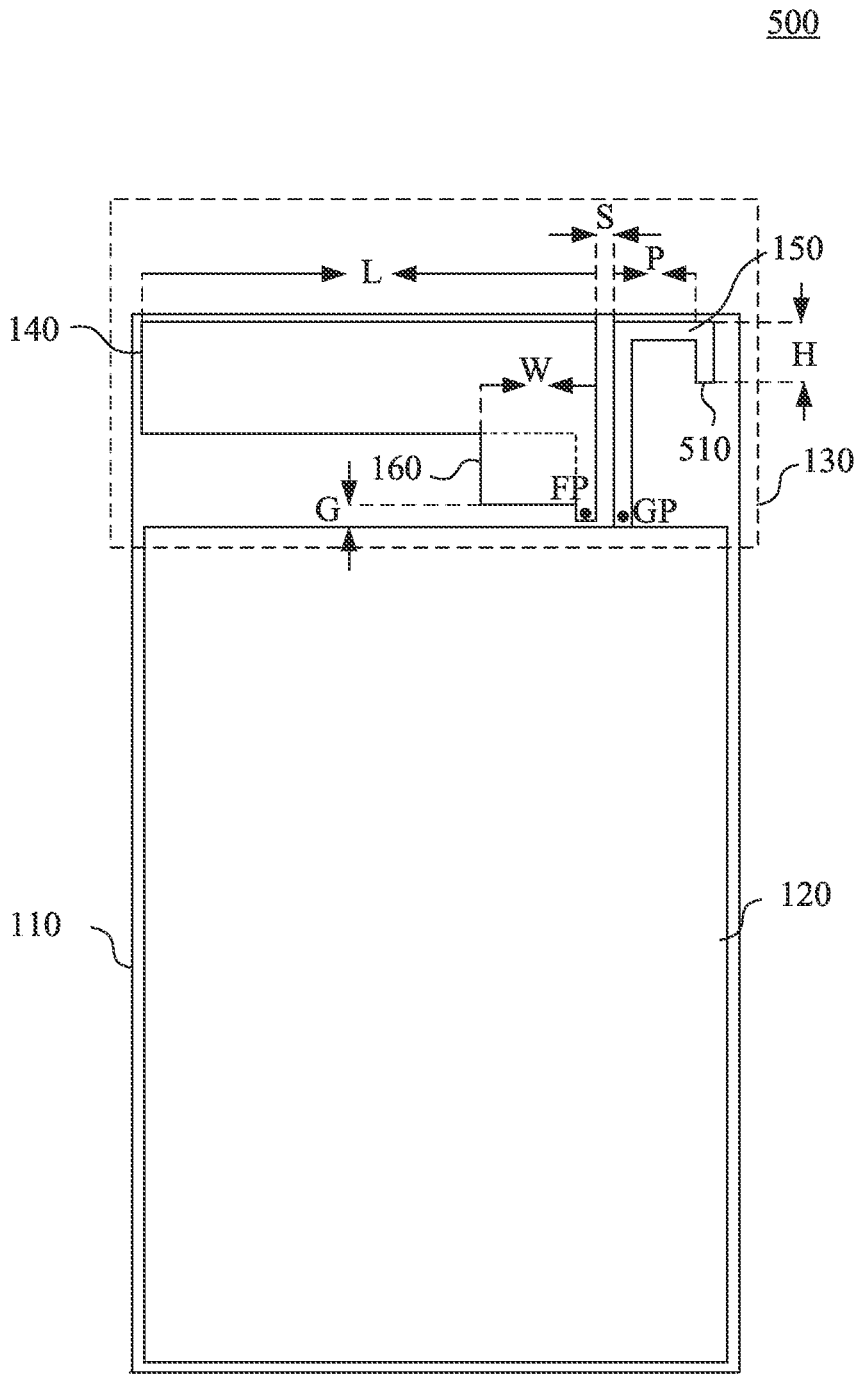
FIG. 5 is a top view of a wireless communication apparatus according to an embodiment of the present invention.

Reference is now made to FIG. 5. FIG. 5 is a top view of a wireless communication apparatus 500 according to an embodiment of the present invention. Similar to the wireless communication apparatus 100 illustrated in FIG. 1, the wireless communication apparatus 500 includes the circuit board 110, the ground plane 120 and the printed dual band antenna 130 and the printed dual band antenna 130 includes the primary radiation portion 140 and the parasitic radiation portion 150. However, in the present embodiment, the parasitic radiation portion 150 includes a bending portion 510. The bending portion 510 has a length H.

Figure 6A:
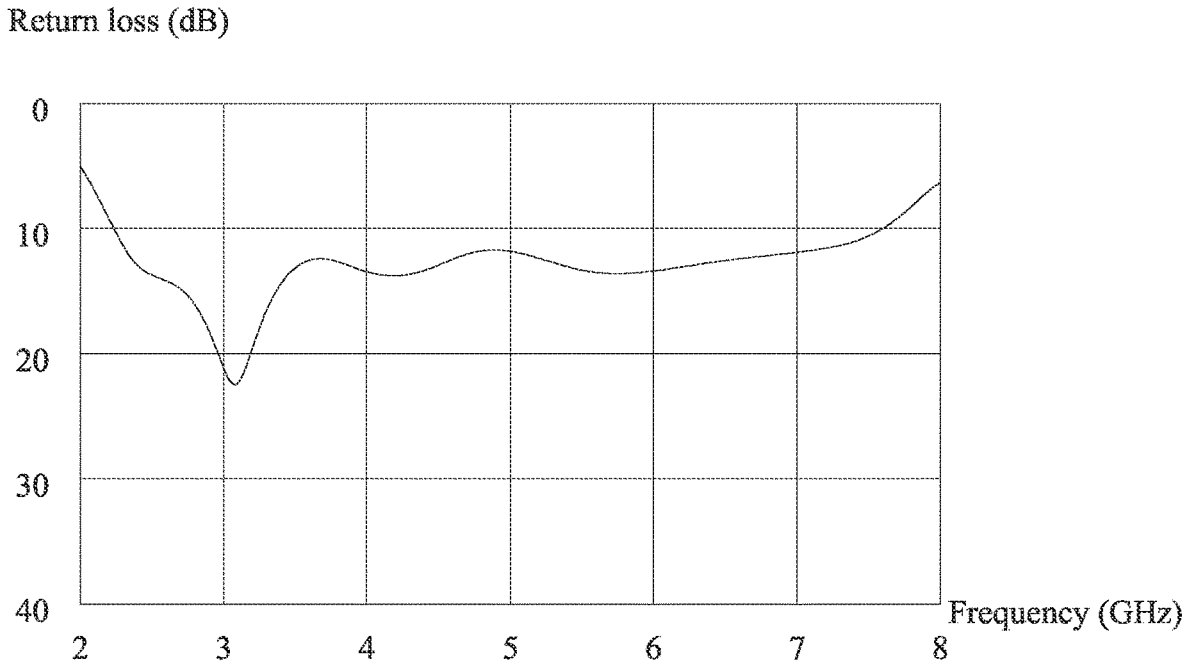
FIG. 6A illustrates a diagram of the frequency responses of the printed dual band antenna in FIG. 5 according to an embodiment of the present invention.
Figure 6B:
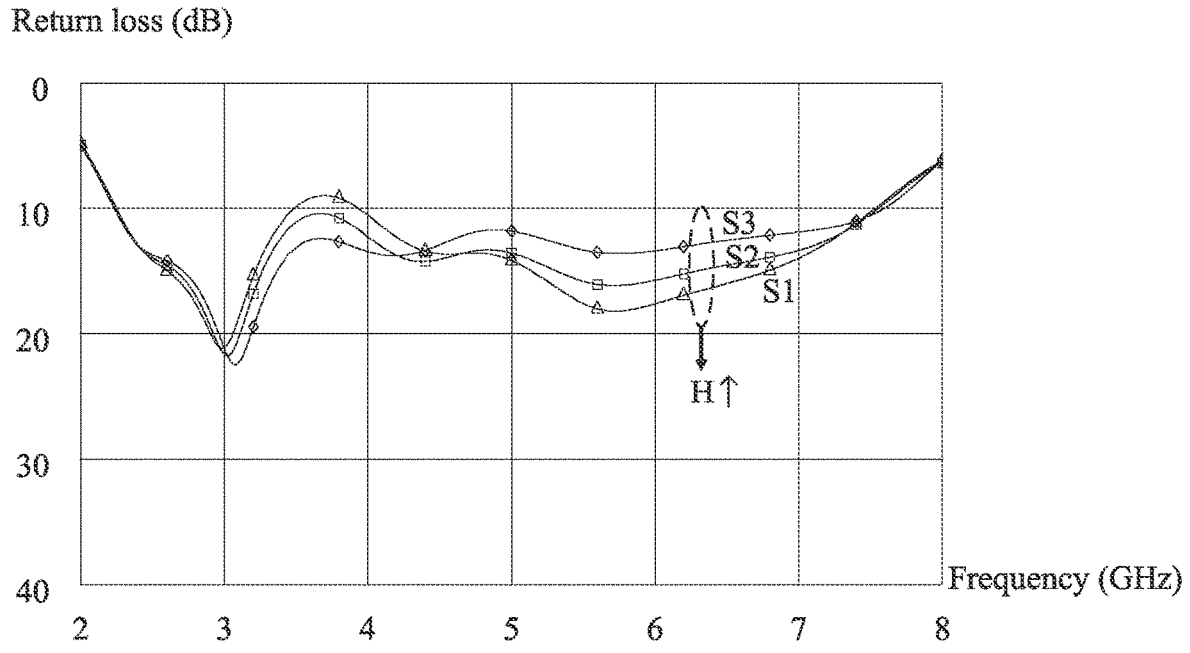
FIG. 6B illustrates a diagram of the frequency responses of the printed dual band antenna in FIG. 5 when a length of the bending portion is different according to an embodiment of the present invention.

Reference is now made to FIGS. 6A and 6B at the same time. FIG. 6A illustrates a diagram of the frequency responses of the printed dual band antenna 130 in FIG. 5 according to an embodiment of the present invention. In FIG. 6A, an X-axis represents the frequency having a unit of GHz and a Y-axis represents the return loss having a unit of dB. FIG. 6B illustrates a diagram of the frequency responses of the printed dual band antenna 130 when the length H of the bending portion 510 is different according to an embodiment of the present invention. In FIG. 6B, an X-axis represents the frequency having a unit of GHz and a Y-axis represents the return loss having a unit of dB.

As shown in FIG. 6A, the disposition of the bending portion 510 can modify the length of the parasitic radiation portion 150 such that the printed dual band antenna 130 can operate as an ultra-wideband antenna. The 10 dB fractional bandwidth (FBW) of the printed dual band antenna 130 in FIG. 5 is 108.8% (2.24-7.59 GHz).

As illustrated in FIG. 6B, the line section S1 that includes triangle-shaped grids disposed thereon represents the frequency response under the condition that the length H is 1.0 millimeters. The line section S2 that includes square-shaped grids disposed thereon represents the frequency response under the condition that the length H is 2.0 millimeters. The line section S3 that includes diamond-shaped grids disposed thereon represents the frequency response under the condition that the length H is 3.0 millimeters.

As shown in FIG. 6B, the modification of the length H of the parasitic radiation portion 150 is able to adjust the operation frequency of the printed dual band antenna 130 in a middle frequency range to obtain an operation characteristic of a ultra-wideband antenna. When the length H is in a range of 2.0-3.0 millimeters, decreases from 2.0 millimeters to 1.0 millimeters, the operation frequency of the antenna can meet the wideband requirement of 6 GHz frequency band of WiFi 6E (5.925-7.125 GHz).

In some approaches, a large area antenna design is used in order to increase the bandwidth of the antenna, which is undesirable under the condition that the size of the electronic products becomes smaller and smaller. The printed dual band antenna of the present invention can make use of the characteristic of the dual band operation of the primary radiation part to further dispose a parasitic radiation portion such that a wideband antenna operation characteristic can be obtained when the sizes of the components are appropriately adjusted. The printed dual band antenna is able to have a good antenna radiation characteristic and maintain a smaller size at the same time.

It is appreciated that the embodiments described above are merely an example. In other embodiments, it should be appreciated that many modifications and changes may be made by those of ordinary skill in the art without departing, from the spirit of the invention.

For example, in an embodiment, the number of the parasitic radiation portion can be more than one and these parasitic radiation portions are electrically isolated from each other. In an embodiment, take the wireless communication apparatus 100 in FIG. 1 as an example, the other parasitic radiation portions can be disposed at a side of the primary radiation portion 140 that is opposite to the side of the primary radiation portion 140 that the parasitic radiation portion 150 is disposed. These additional parasitic radiation portions can be distanced from the primary radiation portion 140 by a distance to obtain a desired resonant result. In another embodiment, the number of the bending portion 510 included by the parasitic radiation portion 150 in FIG. 5 can also be more than one to obtain a desired resonant result.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A printed dual band antenna comprising:

a primary radiation portion disposed on a circuit board, having an L-shaped and configured to perform signal transmitting and receiving based on a first resonant frequency and a second resonant frequency;

a parasitic radiation portion disposed on the circuit board and on a neighboring side of the primary radiation portion, distanced from the primary radiation portion by a distance and electrically isolated from the primary radiation portion, wherein the parasitic radiation portion couples to and resonates with the primary radiation portion to perform signal transmitting and receiving based on the second resonant frequency, and the parasitic radiation portion is a grounded monopole parasitic antenna; and a matching portion disposed on the circuit board and coupled to the primary radiation portion and has a width in parallel and shorter than an extending length of the primary radiation portion extending toward a side opposite to the neighboring side that the parasitic radiation portion is on, in which the width is configured to adjust a high frequency input impedance matching such that a larger width results in a smoother variation of the high frequency input impedance.

2. The printed dual band antenna of claim 1, wherein the primary radiation portion is a monopole primary antenna or an inverted F primary antenna.

3. The printed dual band antenna of claim 2, wherein the monopole primary antenna is an L-shaped antenna.

4. The printed dual band antenna of claim 1, wherein a size of the primary radiation portion and the parasitic radiation portion determines an amount of an input impedance to further determine an amount of an operation frequency.

5. The printed dual band antenna of claim 1, wherein the distance determines a coupling amount between the primary radiation portion and the parasitic radiation portion.

6. The printed dual band antenna of claim 5, wherein the distance is in a range from 0.2 millimeters to 0.8 millimeters.

7. The printed dual band antenna of claim 1, wherein a number of the parasitic radiation portion is larger than one and being electrically isolated from each other.

8. The printed dual band antenna of claim 1, wherein the grounded monopole parasitic antenna comprises a bending portion.

9. A wireless communication apparatus, comprising:

a circuit board;

a ground plane, disposed on the circuit board; and a printed dual band antenna comprising:

a primary radiation portion disposed on the circuit board, having an L-shaped and configured to perform signal transmitting and receiving based on a first resonant frequency and a second resonant frequency;

a parasitic radiation portion disposed on the circuit board and on a neighboring side of the primary radiation portion, distanced from the primary radiation portion by a distance and electrically isolated from the primary radiation portion, wherein the parasitic radiation portion couples to and resonates with the primary radiation portion to perform signal transmitting and receiving based on the second resonant frequency, and the parasitic radiation portion is a grounded monopole parasitic antenna that is coupled to the ground plane; and a matching portion disposed on the circuit board and coupled to the primary radiation portion and has a width in parallel and shorter than an extending length of the primary radiation portion extending toward a side opposite to the neighboring side that the parasitic radiation portion is on, in which the width is configured to adjust a high frequency input impedance matching such that a larger width results in a smoother variation of the high frequency input impedance.

* * * * *